US005510587A

United States Patent [19]

Reiter

[11] Patent Number: 5,510,587

[45] Date of Patent: Apr. 23, 1996

[54] ELECTRIC CIRCUIT ACTUATING MECHANISM

[75] Inventor: John P. Reiter, Apple Valley, Minn.

[73] Assignee: Reitech Corporation, Burnsville, Minn.

[21] Appl. No.: 325,795

[22] Filed: Oct. 19, 1994

[51] Int. Cl.[6] ..... H01H 3/12

[52] U.S. Cl. ..... 200/341; 200/329; 200/5 A; 200/330

[58] Field of Search ..... 200/341, 329, 200/330, 333, 334, 5 A, 5 R, 61.54, 61.55, 520, 533

[56] References Cited

U.S. PATENT DOCUMENTS

| | | | |
|---|---|---|---|
| 1,045,394 | 11/1912 | Griebe et al. . | |
| 1,443,867 | 1/1923 | Burns | 200/50 A |
| 1,706,518 | 3/1929 | Blough . | |
| 2,730,587 | 1/1956 | Feltwell . | |
| 2,835,771 | 5/1958 | Rausch | 200/334 |
| 2,957,960 | 10/1960 | Ginn . | |
| 2,967,916 | 1/1961 | Williams | 200/44 |
| 3,081,390 | 3/1963 | Lasar . | |
| 3,198,373 | 8/1965 | Ramsing | 200/333 X |
| 3,233,071 | 2/1966 | Bozzell | 200/333 X |
| 3,312,799 | 4/1967 | Reiter . | |
| 3,576,408 | 4/1971 | Meyerhoefer | 200/330 X |
| 3,681,555 | 8/1972 | Ohkita | 200/332 X |
| 4,166,202 | 8/1979 | Reiter | 200/44 |
| 4,206,328 | 6/1980 | Coyle et al. | 200/44 |
| 4,215,257 | 7/1980 | Repplinger | 200/330 |
| 4,389,550 | 6/1983 | Reiter | 200/44 |

FOREIGN PATENT DOCUMENTS

| | | | |
|---|---|---|---|
| 698863 | 10/1940 | Germany | 200/75 |

*Primary Examiner*—Henry J. Recla
*Assistant Examiner*—David J. Walczak
*Attorney, Agent, or Firm*—Peterson, Wicks, Nemer & Kamrath

[57] ABSTRACT

A mechanism (10) for actuating an electric circuit is shown including a switch box (11) fastened to a housing (26) to which a cover (60) is movably mounted. The threaded stems (54) of four de-energizing momentary switches (52) extend through and are held to the front wall (32) of the housing (26). The cover (60) includes a sleeve extending rearwardly of its broad surface front wall (62) and slideably received in a tubular extension (46) of the housing (26). A flange (72) on the sleeve abuts with ledges (50) formed in the tubular extension (46) to prevent movement therebeyond. The cover (60) can be pushed against the bias of coil springs (74) arranged concentrically around the stems (54) such that any point of the broad surface front wall (62) can be moved in an actuation direction to slide the actuating pins (58) slideable in the stems (54) of one or more of the de-energizing switches (52) to de-energize the electric circuit. The electric circuit is energized by actuating an energizing momentary switch (18) mounted to the switch box (11).

22 Claims, 1 Drawing Sheet

ELECTRIC CIRCUIT ACTUATING MECHANISM

BACKGROUND

This invention relates generally to a safety device for power tools and more specifically to an electric circuit actuating mechanism which when appropriately mounted on a power tool stand, allows the operator to turn on the tool's drive motor by a conscious depression of a relatively small sized push button switch, but permits the motor to be turned off by depression of a relatively broad surface by a body part and especially by a body part other than the hands of the operator whereby there is no need for the operator to take his eyes or hands off the work and the cutting or abrading tool.

U.S. Pat. Nos. 3,312,799; 4,166,202; and 4,389,550 each describe various forms of switch actuating mechanisms including á broad surface panel member of one type or another pivotally mounted in proximity to the operator's station and this member is mechanically linked to the on/off lever of the toggle switch. Once the motor of the tool is turned on, it may be turned off by bumping the broad surface panel member with one or more parts of the operator's anatomy other than his hands and this operation may be accomplished without having to glance away from the working surface of the tool being used. This, of course, leads to greater safety by preventing accidental or inadvertent movement of the workpiece or hands into a position where they may be injured by the tool.

However, it can be appreciated that due to the hinged mounting of the broad surface in U.S. Pat. Nos. 3,312,799; 4,166,202; and 4,389,550, bumping the broad surface member along the edge adjacent and parallel to the pivot axis as well as adjacent to the pivot axis may not cause the broad surface member to pivot and cause actuation of the switch or result in turning off the motor of the tool. Although other manners of mounting the broad surface members are known such as shown in U.S. Pat. No. 3,233,071, while reducing the possibility that pushing the broad surface member would not cause actuation of the switch, such arrangements did not eliminate the possibility.

Further, the fabrication of prior actuating mechanisms tended to be overly costly to manufacture because of the number of parts involved, making it somewhat difficult to market at a price commensurate with the cost of the tool on which the safety mechanism was adapted to be used.

The present invention according to the preferred teachings provides an electric circuit actuating mechanism of the general type described but is designed to be substantially less complicated in terms of the number of parts and their assembly into a completed article. This has been done while increasing the element of safety for which the earlier devices were designed.

Specifically, the present invention solves problems encountered by prior mechanisms in the field of electric circuit actuation and other needs in the field by providing, in the most preferred form, a front wall movably mounted relative to a housing enabling any point of the front wall to move in an actuating direction and to slide actuating pins of one or more of a multiplicity of de-energizing momentary switches to de-energize an electric circuit, with the electric circuit being energized by an energizing momentary switch which is not actuated by movement of the front wall.

It is accordingly the principal object of the present invention to provide a new and improved safety device for use in conjunction with electrical motor-driven power tools or the like.

Another object of the invention is to provide an electric circuit actuating mechanism for use with electrically powered tools and disposed such that the power may be turned on by the depression of a first switch and turned off through the application of a force against a broad surface.

Yet another object of the invention is to provide an improved safety device for the control of power-driven tools, the safety device including a broad surface movably mounted to a switch box which, in turn, is arranged to be connected at a desired location on a power tool stand whereby the operator's knee, thigh, hip or other part of his anatomy other than his hands may be used to disconnect the power tool from its power supply.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
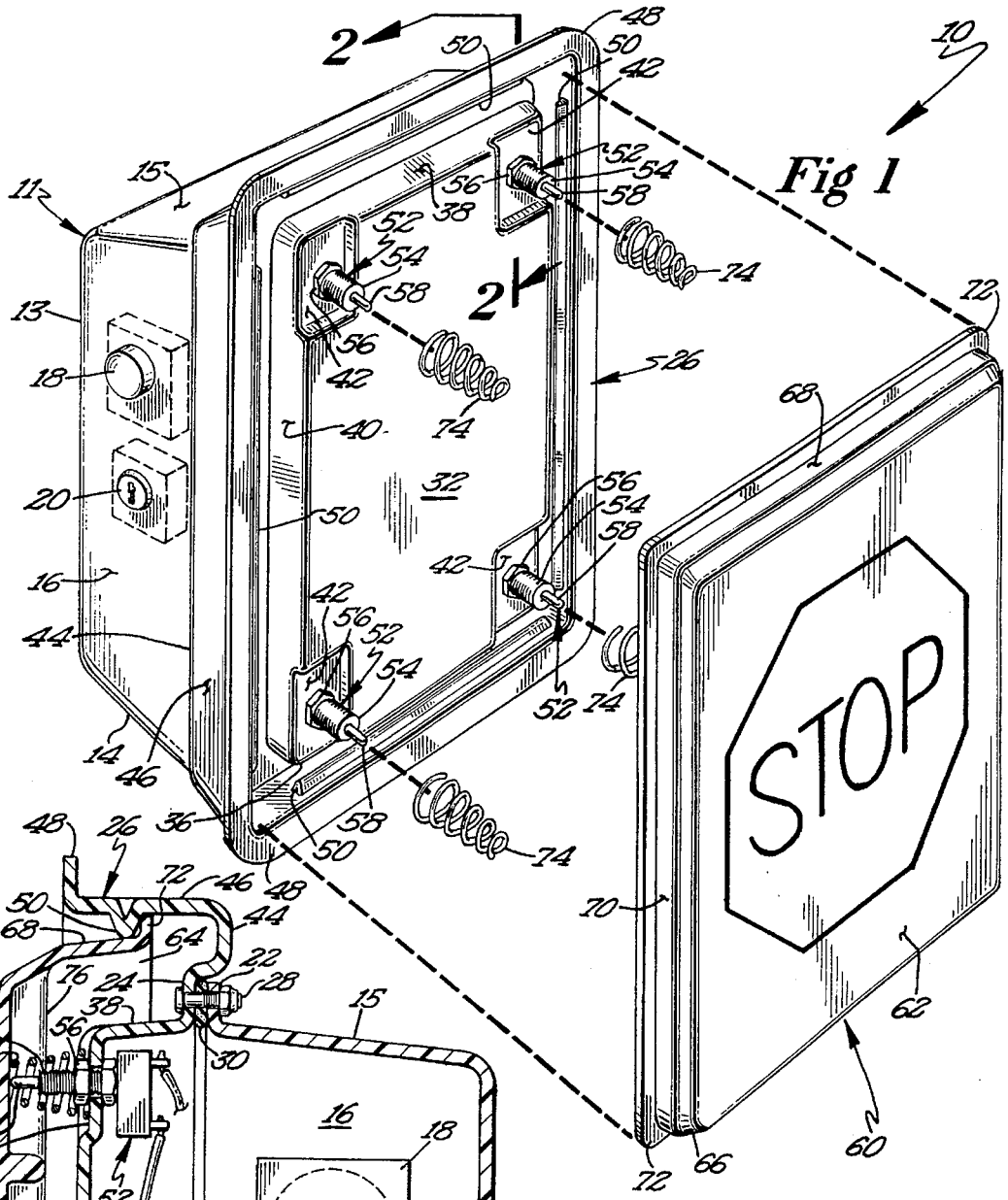
FIG. 1 shows an exploded perspective view of an electric circuit actuating mechanism according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "front", "back", "outer", "inner", "upper", "lower", "height", "width", "length", "end", "side", "horizontal", "vertical", "rear", and similar terms are used herein, it should be understood that these terms have reference only to the structure shown in the drawings as it would appear to a person viewing the drawings and are utilized only to facilitate describing the invention.

DESCRIPTION

An electric circuit actuating mechanism according to the preferred teachings of the present invention is shown in the drawings and generally designated 10. Mechanism 10 generally includes a first generally rectangular box-like enclosure or switch box 11 having an open front 12, a rear wall 13, a bottom wall 14, an upper or top wall 15 and integrally formed side walls 16. Bottom wall 14 has one or more apertures (not shown) passing through it allowing electrical wiring to be routed from a source of power into switch box 11 and out of switch box 11 to the power tool or device being controlled. Alternately, mechanism 10 could be in an extension cord-type arrangement where switch box 11 could include a female outlet mounted thereto for electrical connection to the male plug of the power tool wished to be actuated and could also include a cord extending therefrom terminating in a male plug for electrical connection to a conventional wall outlet or the like.

In fabricating mechanism 10 of the present invention, it has been found expedient to use an energizing momentary switch 18 which operates through a control relay 19 to selectively energize the electric circuit. The control relay 19 generally has a coil and a plurality of normally open contacts. The coil is arranged to be connected in series with the contacts of switch 18 and between the power terminal such that a momentary closure of switch 18 will cause the coil to be momentarily engergized. This momentary energization, in turn, causes a first set of normally open contacts to close and latch the relay coil in an energized state such that it will continue to be energized even when switch 18 is released so as to return to its original position. Additional control relay contacts close to connect the terminals across the power terminals. Control relay 19, itself, may conveniently be mounted within the switch box or enclosure 11. In the most preferred form, switch 18 is mounted in an aperture formed in one of the side walls 16. Further in the most preferred form, a key-operated lock 20 is mounted in an aperture formed in one of the side walls 16 preferably adjacent to switch 18 and prevents the closure of switch 18 to energize the coil or cause the first set of normally open contacts to close. In the most preferred form, switch 18 and lock 20 are commercially available and use a threaded cylindrical stem which is arranged to pass through the apertures in side walls 16 so as to be held in place by a locking nut screwed onto the threaded stem.

Switch box 11 has an annular flange 22 extending outwardly from walls 14–16 parallel to open front 12. Flange 22 serves as a means whereby switch box 11 may be fastened to an annular base 24 of a housing 26. Specifically, switch box 11 may conveniently be bolted to base 24 of housing 26 by means of bolts 28 passing through base 24 and flange 22. In the most preferred form, a seal gasket 30 is sandwiched between flange 22 and base 24.

Housing 26 is a rectangular box-like enclosure having a front plate or wall 32, an open rear 34, a bottom wall 36, an upper or top wall 38, and integrally formed side walls 40. Base 24 extends outwardly from walls 36, 38, and 40 parallel to open rear 34. A depression 42 is formed at each corner of housing 26 in walls 32, 36, 38, and 40. An annular, trough-shaped flange 44 is integrally secured to the outer edge of base 24 opposite walls 36, 38, and 40. In the most preferred form, flange 44 has semicircular cross sections, with base 24 extending generally perpendicularly to the upper edge of the first leg of flange 44. A tubular extension 46 extends generally linearly from the upper edge of the other leg of flange 44 to a distance beyond front wall 32. The outer edge of extension 46 terminates in a free edge having an annular, outwardly extending flange 48. In the most preferred form, extension 46 includes V-shaped ledges 50 extending inwardly from extension 46 spaced inwardly of the free edge of extension 46 at a constant distance intermediate base 24 and front wall 32. It can be appreciated that ledges 50 adjacent wall 36 are in a parallel, spaced relation to ledges 50 adjacent wall 38 and that ledges 50 adjacent to first and second side walls 40 are similarly in a parallel, spaced relation. In the preferred form shown, ledges 50 are spaced from the corners of extension 46 but ledges 50 could extend around the entire circumference of extension 46 for better dust control if desired or necessary.

Mechanism 10 of the present invention further includes a multiplicity and specifically four de-energizing momentary switches 52 mounted to housing 26 in a spaced arrangement, with no three switches being arranged in a linear manner in the preferred form and being arranged at the corners of a right parallelepiped and in the most preferred form shown as arranged adjacent the corners of front wall 32 and specifically in depressions 42 thereof. Actuation of one or more of switches 52 causes the first set of normally open contacts of control relay 19 to open and release the relay coil into a de-energized state. The first contacts will remain open and the relay coil will remain de-energized until and unless switch 18 is actuated as previously set forth. Switches 52 are commercially available and use a threaded stem 54 which is arranged to pass through apertures in depressions 42 so as to be held in place by a locking nut 56 screwed onto stem 54. In the most preferred form, the depth of depressions 42 is generally equal to the height of nuts 56 on stem 54. Actuating pins 58 are slideable inside stems 54, with pins 58 being biased outward of stem 54 from a first position to a second position and slideable into stem 54 against the bias to actuate switches 52 when pins 58 are slid from the second position.

Mechanism 10 of the present invention further includes a cover 60 movable relative to housing 26. Cover 60 is a rectangular, box-like structure having a broad surface front wall or panel 62, an open rear 64, a bottom wall 66, an upper or top wall 68, and integrally formed side walls 70. An annular flange 72 extends parallel to open rear 64 and outwardly from walls 66, 68, and 70 which define a sleeve extending rearwardly from front wall 62 and having a size corresponding to and for receipt within tubular extension 46 of housing 26. The outer edge of flange 72 extends outwardly of the inner edges of ledges 50. Housing 26 and/or cover 60 have sufficient flexibility to place flange 72 behind ledges 50 for assembly but generally prevent normal removal. Due to spacing of ledges 50 from the free edge of extension 46, flange 72 is recessed behind the free edge and inside of extension 46.

Mechanism 10 according to the preferred teachings of the present invention includes suitable members 74 for biasing cover 60 outwardly from housing 26 such that flange 72 abuts with ledges 50. In the preferred form, members 74 are a multiplicity of coil springs corresponding to the number of switches 52 and in the most preferred form which are positioned concentrically around stems 54 of switches 52 and sandwiched between depressions 42 and wall 62. Thus, positioning bosses for springs 74 are not required on housing 26 and/or cover 60. It can then be appreciated that the sleeve formed by walls 66, 68, and 70, tubular extension 46, ledges 50, flange 72, and springs 74 movably mount front wall 62 relative to housing 26 in a free floating arrangement enabling any point of the broad surface of front wall 62 to move in an actuation direction which is towards front wall 32 in the most preferred form from a normal position to an actuation position, with front wall 62 being biased by springs 74 from the actuation position to the normal position. In the normal position, flange 72 abuts with ledges 50 of tubular extension 46 and prevent movement of cover 60 therebeyond in a direction opposite to the actuation direction. It should further be realized that cover 60 is movable inward of housing 26 against the bias of springs 74 by pushing on front wall 62 to thereby separate flange 72 or portions thereof from ledges 50 in the actuation direction. In the most preferred form, pins 58 abut with the rear surface of front wall 62 and do not actuate switches 52 with cover 60 biased outwardly with flange 72 abutting with all of the ledges 50. Thus, movement of front wall 62 towards stems 54 will immediately cause pins 58 to slide in stems 54 in a direction opposite to the bias direction of pins 58 in stems 54 and actuate switch 52.

In the most preferred form of the present invention, the back surface of front wall 62 includes a network of ribs 76. It can then be appreciated that ribs 76 increase the strength of front wall 62 and cover 60 allowing their formation from reduced thickness materials. However, more importantly in the most preferred form, ribs 76 are designed to engage front wall 32 before actuating pins 58 are forced to over travel and thus protect switches 52. In addition, it can be appreciated that depressions 42 create further spacing from front wall 62 such that the length (and diameter) of stems 54 can be increased to maximize the size of switches 52 which can be utilized.

Switch box 11, housing 26, and cover 60 are preferably fabricated from sheet metal or plastics, as is conventional for electrical switch boxes.

Now that the details of the construction of mechanism 10 according to the preferred teachings of the present invention have been set forth, consideration will be given to its mode of operation and advantages. As has already been mentioned, the present invention comprises a safety device in the form of electric circuit actuating mechanism 10 for facilitating the control of electrical circuits such as for drive motors or the like commonly used with power tools. For example, the present invention may be used with a wide variety of power tools including table saws, drill presses, lathes, sanders, joiner/planers and the like. Mechanism 10 is mounted at a convenient location proximate the operator's usual work station and power is brought into and out of switch box 11 as set forth previously from motor control relay 19 which is housed Within switch box 11. Thus, due to the solid construction of switch box 11 and of housing 26 and specifically front wall 32 thereof, the interior defined by switch box 11 and housing 26 fastened together with gasket 30 in the most preferred form encloses the electrical components of switches 18 and 52, lock 20, and relay 19 and protects them from the environment such as but not limited to sawdust and the like which may be in the air.

To start the motor, the operator must first unlock mechanism 10 by rotating the key for lock 20. The operator may now depress switch 18 to complete the circuit to control relay 19 causing relay 19 to latch up and maintain a closed circuit between the power supply and the motor being controlled. The operator may remove his finger from switch 18 and, in doing so, the internal spring of momentary switch 18 will force switch 18 back to its starting position. It can then be appreciated that actuation of switch 18 does not occur as the result of movement of front wall 62 or cover 60.

Figure 2:
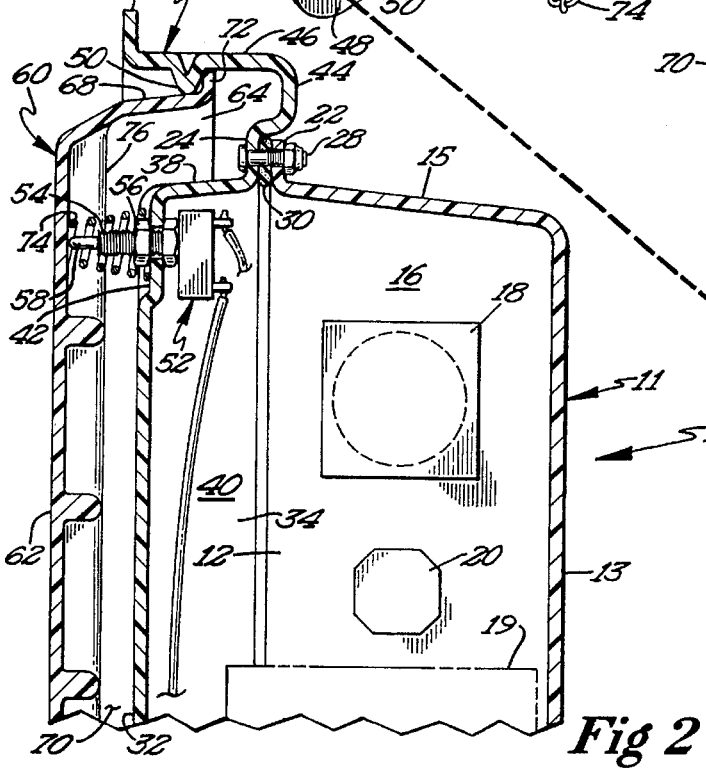
FIG. 2 shows a partial, cross-sectional view of the electric circuit actuating mechanism of FIG. 1 according to section line 2—2 of FIG. 1.

All the while, the machine will be running in that the momentary closure of switch 18 effected an energization of control relay 19 and its latching contacts. When the operator desires to again turn off the motor, he may apply a force either with his hand, but preferably with another part of his anatomy such as his thigh, knee or hip, against surface 62 to thereby overcome the force of one or more of coil springs 54 and force surface 62 against one or more of pins 58 of switches 52. Depression of surface 62 against the force of springs 54 then causes pins 58 to move to the right viewed in FIG. 2 such that one or more of switches 52 are actuated. During its travel, the electrical connection to the motor control relay coil is momentarily broken, causing the latching contacts to release and disconnecting the motor from the power supply. When surface 62 is released, coil springs 54 return it to its Vertical orientation while the internal spring associated with pins 58 ensure that they will also be returned to their at-rest position with pins 58 in their outer orientations.

It can then be appreciated that de-energization of the electric circuit can be accomplished by pushing surface 62 in different manners. Specifically, surface 62 can be pushed to separate the portion of flange 72 adjacent to wall 68 from the portion of ledges 50 adjacent wall 38 causing cover 60 to pivot about an axis parallel to the portion of flange 72 adjacent to wall 66 and the portion of ledges 50 adjacent wall 36 in a similar manner as in U.S. Pat. No. 4,389,550. It can be appreciated that the portions of flange 72 adjacent to walls 70 will separate in a non-parallel manner from ledges 50 adjacent to walls 40. Such movement of surface 62 will slide actuating pins 58 of the two switches 52 adjacent to wall 38 inward to thus de-energize the electric circuit. However, unlike U.S. Pat. No. 4,389,550, surface 62 can be pushed to separate the portion of flange 72 adjacent to wall 66 from the portion of ledges 50 adjacent wall 36 causing cover 60 to pivot about an axis parallel to the portion of flange 72 adjacent to wall 68 and the portion of ledges 50 adjacent wall 38. It can be appreciated that the portions of flange 72 adjacent to walls 70 will separate in a non-parallel manner from ledges 50 adjacent to walls 40. Such movement of surface 62 will slide actuating pins 58 of the two switches 52 adjacent to wall 36 inward to thus de-energize the electric circuit. Furthermore, unlike U.S. Pat. No. 4,389,550, surface 62 can be pushed to separate the portion of flange 72 adjacent to one of the first and second side walls 70 from the portion of ledges 50 adjacent to the corresponding side wall 40 of housing 26 causing cover 60 to pivot about an axis parallel to the portion of flange 72 adjacent the other of the first and second side walls 70 from the portion of ledges 50 adjacent to the corresponding side wall 40 of housing 26. It can be appreciated that the portions of flanges 72 adjacent to walls 66 and 68 will separate in a non-parallel manner from ledges 50 adjacent to walls 36 and 38. Such movement of surface 62 will slide actuating pins 58 of the two switches 52 adjacent to wall 40 adjacent to the portion of flange 72 separated from ledge 50 inward to thus de-energize the electric circuit. Further, unlike U.S. Pat. No. 4,389,550, surface 62 can be pushed to separate the portion of flange 72 adjacent to the corner between wall 66 and the first side wall 70 from the portions of ledges 50 adjacent to the corner between wall 36 and the first side wall 40 causing cover 60 to pivot about an axis parallel to the portion of flange 72 adjacent to wall 68 and second side wall 70 and the portions of ledges 50 adjacent wall 38 and the second side wall 40. It can be appreciated that the remaining portions of flange 72 will separate in a non-parallel manner from the remaining portions of ledges 50. Such movement of surface 62 will slide actuating pin 58 of switch 52 adjacent to the corner of wall 36 and first side wall 40 inward to thus de-energize the electric circuit. Similarly, cover 62 can be pushed to slide actuating pin 58 of switches 52 adjacent the other corners of front wall 32.

It can then be appreciated that the positioning of the body part other than the hand such as thigh, knee, or hip on surface 62 is not as accurate as a hand would be, especially when surface 62 is not being viewed and even further under emergency situations where fast actuation is desired. Mechanism 10 then provides a substantial improvement over mechanisms including actuation surfaces which are pivotally mounted through the use of a hinged mounting such as in U.S. Pat. Nos. 3,312,799; 4,166,202; and 4,389,550 in the ability to quickly and consistently de-energize the electric circuit. Furthermore, the present invention provides a substantial improvement over mechanisms including actuating surfaces which are not mounted through the use of hinge mountings such as in U.S. Pat. No. 3,233,071. Specifically, such mechanisms were not consistent in causing actuation of the switch. For example, in some circumstances, the surface would bottom out by hitting other portions of the mechanism before actuating the switch. Further, considerable travel of the surface would be required especially when pushed at the corner before the switch was actuated, and similarly considerable force would be required in these circumstances especially if a typical start/stop type switch was utilized. Mechanism 10 according to the teachings of the present invention then takes a novel and unique design direction from prior mechanisms such as shown in U.S. Pat. No. 3,233,071. Specifically, momentary switches 18 and 52 are utilized such that the amount of travel of surface 62 and the amount of force to push surface 62 required to actuate switches 52 are minimized. But more importantly, the use of momentary switches 52 allows the use of a multiplicity of switches 52. Use of more than one start/stop type switch as in U.S. Pat. No. 3,233,071 is not possible and/or is impractical. It can then be appreciated that multiple momentary switches 52 according to the teachings of the present invention allows them to be spaced from each other such that different movements of surface 62 will actuate one or more of such switches 52 especially if switches 52 are arranged in a nonlinear manner in the preferred form and at the corners of a right parallelepiped in the most preferred form. Thus, mechanism 10 according to the teachings of the present invention effectively eliminates the possibility that pushing front wall 62 will not cause actuation of one or more switches 52 causing de-energization of the electric circuit and over comes the disadvantages and limitations of prior mechanisms including but not limited to the types as shown in U.S. Pat. Nos. 3,233,071; 3,312,799; 4,166,202; and 4,389,550.

To lock actuating mechanism 10 and to thereby prevent unauthorized use of the power tool, the operator turns the key for lock 20 which prevents switch 18 from energizing control relay 19 and removes the key. In the most preferred form, lock 20 is a key-operated electrical switch which, when a proper key is inserted in the tumbler and rotated, the switch is operative to apply electrical current to the utilization device via switch 18. However, when the key-operated electrical switch is off, the circuit is broken to switch 18 and actuation thereof is incapable of initiating operation of the motor or other device utilizing actuating mechanism 10 of the present invention.

By making switch 18 relatively small and by placing switch 18 in switch box 11 behind housing 26 and cover 60 and specifically behind front wall 62 of cover 60, accidental operation of switch 18 is practically eliminated. It of course can be appreciated that switch 18 can be located at other positions in switch box 11 or at positions other than in switch box 11 according to the teachings of the present invention as long as actuation of switch 18 does not occur as the result of the movement of front wall 62 or cover 60. Once switch 18 is operated to turn the machine on, the operator need not search around for an OFF switch in that application of a force anywhere on surface 62 functions to turn off the machine.

It can then be appreciated that telescoping walls 66, 68, and 70 defining the sleeve of cover 60 inside extension 46 and spacing ledges 50 from the free edge and inside extension 46 are believed to be advantageous in making disassembly more difficult. Specifically, if cover 60 were telescoped on the outside of housing 26 such as disclosed in U.S. Pat. No. 3,233,071, the back edges of the cover could be easily flexed outwardly to release the cover from the housing, with such flexing being the result of an object accidentally catching on the back edges or by simply being gripped by the fingers of a vandal which can be a significant problem in a school or similar environment. Due to the construction of mechanism 10 according to the preferred teachings of the present invention, disassembly requires extension 46 and flange 48 to be flexed outwardly and/or walls 66, 68, and 70 and flange 72 to be flexed inwardly which is very difficult to perform especially when mechanism 10 is mounted on the work station.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Mechanisms for actuating an electric circuit comprising, in combination: a housing; a front wall having a broad surface; means for movably mounting the front wall relative to the housing enabling any point of the broad surface to move in an actuation direction from a normal position to an actuation position, with the front wall being biased from the actuation position to the normal position; and a multiplicity of de-energizing momentary switches mounted to the housing in a spaced arrangement, with the de-energizing momentary switches each including a slideable actuating pin biased in a direction opposite to the actuation direction from a first position to a second position, with movement of any point of the broad surface of the front wall in the actuation direction from the normal position sliding the actuating pin of at least one of the de-energizing momentary switches in the actuation direction, with the de-energizing momentary switches de-energizing the electric circuit when the actuating pin of at least one of the de-energizing momentary switches is slid in the actuation direction from the second position, with the energizing of the electric circuit not occurring as the result of the movement of the front wall.

2. The electric circuit actuating mechanism of claim 1 wherein at least three de-energizing momentary switches are arranged in a non linear manner.

3. The electric circuit actuating mechanism of claim 2 wherein four de-energizing momentary switches are arranged at the corners of a right parallelepiped.

4. The electric circuit actuating mechanism of claim 2 wherein the movably mounting mechanism comprises, in combination:

a multiplicity of coil springs corresponding to the number of de-energizing momentary switches, with the coil springs being sandwiched between the housing and the front wall and located concentric to the actuating pin.

5. The electric circuit actuating mechanism of claim 4 wherein the movably mounting mechanism comprises, in combination:

ledge portions located in a spaced relation on one of the housing and the front wall; and flange portions on the other of the housing and the front wall for abutting with the ledge portions in the normal position, with the flange portions being movable from the ledge portions when the front surface moves from the normal position.

6. The electric circuit actuating mechanism of claim 5 wherein the housing includes a tubular extension; and wherein the front wall includes a sleeve of a size corresponding to and for receipt within the tubular extension, with the ledge portions located on one of the tubular extension and the sleeve and the flange portions located on the other of the tubular extension and the sleeve.

7. The electric circuit actuating mechanism of claim 6 wherein the tubular extension includes a free edge, with the tubular extension including the ledge portions spaced from the free edge in the actuating direction to recess the flange portions inside of the tubular extension.

8. The electric circuit actuating mechanism of claim 7 further comprising, in combination: at least one energizing momentary switch which can be actuated to energize the electric circuit, with the actuation of the energizing momentary switch not occurring as the result of the movement of the front wall.

9. The electric circuit actuating mechanism of claim 7 wherein the housing comprises, in combination:

a front plate of a solid construction; and a switch box in the form of an enclosure of a solid construction having an open front, with the front plate closing the open front and defining an interior, with the de-energizing momentary switches mounted to the front plate and located within the interior with the actuating pins sliding through the front plate, with the energizing momentary switch mounted to the switch box, with the interior enabling the electrical components of the switches and the electric circuit to be enclosed therein and environmentally protected.

10. The electric circuit actuating mechanism of claim 9 wherein the front plate includes a multiplicity of depressions corresponding to the number of de-energizing momentary switches and each having a depth; and wherein each of the de-energizing momentary switches include a threaded stem passing through the front plate and for threadable receipt of a nut having a thickness, with the actuating pin of the momentary switch being slideable in the threaded stem.

11. The electric circuit actuating mechanism of claim 10 wherein the depth of the depressions is generally equal to the thickness of the nut.

12. The electric circuit actuating mechanism of claim 1 wherein the movably mounting mechanism comprises, in combination:

a multiplicity of coil springs corresponding to the number of de-energizing momentary switches, with the coil springs being sandwiched between the housing and the front wall and located concentric to the actuating pin.

13. The electric circuit actuating mechanism of claim 1 wherein the movably mounting mechanism comprises, in combination:

ledge portions located in a spaced relation on one of the housing and the front wall; and flange portions on the other of the housing and the front wall for abutting with the ledge portions in the normal position, with the flange portions being movable from the ledge portions when the front surface moves from the normal position.

14. The electric circuit actuating mechanism of claim 13 wherein the housing includes a tubular extension; and wherein the front wall includes a sleeve of a size corresponding to and for receipt within the tubular extension, with the ledge portions located on one of the tubular extension and the sleeve and the flange portions located on the other of the tubular extension and the sleeve.

15. The electric circuit actuating mechanism of claim 14 wherein the tubular extension includes a free edge, with the tubular extension including the ledge portions spaced from the free edge in the actuating direction to recess the flange portions inside of the tubular extension.

16. The electric circuit actuating mechanism of claim 1 wherein the housing comprises, in combination:

a front plate of a solid construction; and a switch box in the form of an enclosure of a solid construction having an open front, with the front plate closing the open front and defining an interior, with the de-energizing momentary switches mounted to the front plate and located within the interior with the actuating pins sliding through the front plate, with the energizing momentary switch mounted to the switch box, with the interior enabling the electrical components of the switches and the electric circuit to be enclosed therein and environmentally protected.

17. The electric circuit actuating mechanism of claim 16 wherein the front plate includes a multiplicity of depressions corresponding to the number of de-energizing momentary switches and each having a depth; and wherein each of the de-energizing momentary switches include a threaded stem passing through the front plate and for threadable receipt of a nut having a thickness, with the actuating pin of the momentary switch being slideable in the threaded stem.

18. The electric circuit actuating mechanism of claim 15 wherein the depth of the depressions is generally equal to the thickness of the nut.

19. The electric circuit actuating mechanism of claim 1 wherein the housing includes a front plate having a multiplicity of depressions corresponding to the number of de-energizing momentary switches and each having a depth; and wherein each of the de-energizing momentary switches include a threaded stem passing through the front plate and for threadable receipt of a nut having a thickness, with the actuating pin of the momentary switch being slideable in the threaded stem.

20. The electric circuit actuating mechanism of claim 19 wherein the depth of the depressions is generally equal to the thickness of the nut.

21. The electric circuit actuating mechanism of claim 1 further comprising, in combination:

a network of ribs formed on the front wall, with the housing including a front plate, with the actuating pins of the momentary switches being slideable relative to the front plate; with the network of ribs extending from the front wall to engage the front plate before the actuating pins are forced to over travel in the de-energizing momentary switches.

22. The electric circuit actuating mechanism of claim 1 further comprising, in combination:

at least one energizing momentary switch which can be actuated to energize the electric circuit, with the actuation of the energizing momentary switch not occurring as the result of the movement of the front wall.

* * * * *